US005706543A

United States Patent [19]

Lalevee, Sr.

[11] Patent Number: 5,706,543

[45] Date of Patent: Jan. 13, 1998

[54] PENCIL ERASER CLEANER

[76] Inventor: Russell R. Lalevee, Sr., P.O. Box 338, Chatham, Mass. 02633

[21] Appl. No.: 505,375

[22] Filed: Jul. 21, 1995

[51] Int. Cl.[6] ..... B43K 29/02; B43L 19/00; B25F 1/00

[52] U.S. Cl. ..... 15/105.53; 15/105.51; 15/427; 15/104.001; 401/131; 451/555

[58] Field of Search ..... 15/104.001, 105.51–105.53, 15/423–434; 401/131; 451/523, 552, 555

[56] References Cited

U.S. PATENT DOCUMENTS

| | | | |
|---|---|---|---|
| 501,893 | 7/1893 | Marshall | 15/105.53 |
| 1,063,443 | 6/1913 | Hayes | 15/105.53 |
| 1,093,497 | 4/1914 | Swindowsky | 15/105.53 |
| 2,144,014 | 1/1939 | Finck | 15/105.51 |

FOREIGN PATENT DOCUMENTS

| | | | |
|---|---|---|---|
| 982363 | 6/1951 | France | 15/427 |

*Primary Examiner*—Mark Spisich

[57] ABSTRACT

The present invention relates to removing the graphite that accumulates on the rubber eraser attached at the end of a common pencil. The pencil eraser cleaner is provided with a connecting hole to mount on the eraser end of a pencil with means to be held securely and disconnected easily. The pencil eraser cleaner has four concaved cleaning surfaces for controlled rubbing action.

1 Claim, 1 Drawing Sheet

PENCIL ERASER CLEANER

BACKGROUND OF THE INVENTION

Removing built-up graphite on a pencil eraser by rubbing a eraser on paper to clean is time consuming and inefficient. Rubbing a unclean eraser on a strip of sandpaper will quickly reduce the eraser size. Erasing with a blackened eraser develops a smudge on or about the area being erased. Removing eraser smudge without leaving a trace is difficult, requiring additional erasing thus causing extra wear to the pencil eraser. Rubbing blackened erasar sat on a matted surface easily removes the graphite with minimum wear to the pencil eraser.

SUMMARY OF THE INVENTION

The invention is a new concept to provide the means to cleaning erasers that become coated with graphite. Cleaning a blackened eraser with a rough abrasive means, reduces the size of a pencil eraser prematurely. The new approach to cleaning a pencil eraser comprises the following features:

(a) simplicity of design;

(b) low manufacturing cost;

(c) the pencil eraser cleaner is always available (on) pencil;

(d) prolongs the use of the pencil;

(e) less reason to discard a pencil because the eraser rubbed flat;

(f) less wood used by longer lasting pencil use;

(g) neater paper work.

The invention will be described for the purpose of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
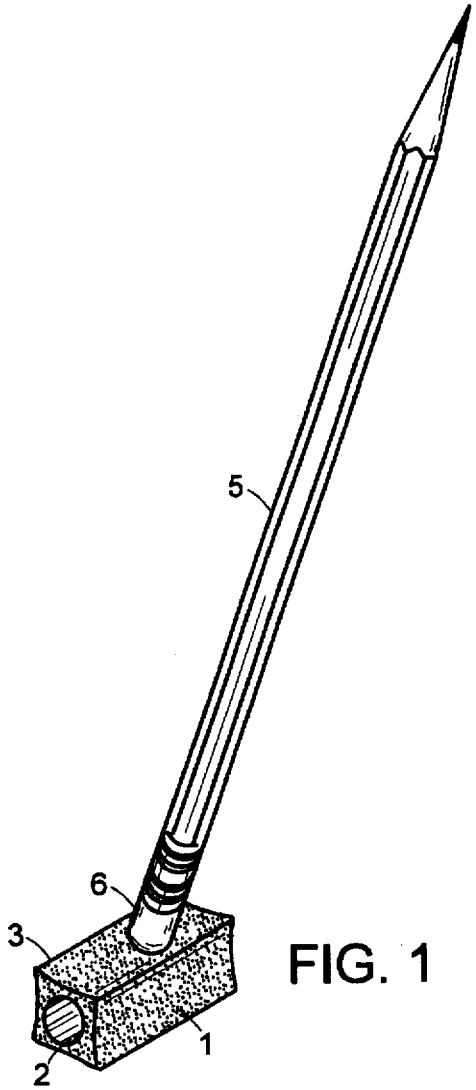
FIG. 1 is a perspective view showing eraser 6 of pencil 5 in a rubbing position to be cleaned on the concave surface 3 of pencil eraser cleaner 1.
Figure 2:
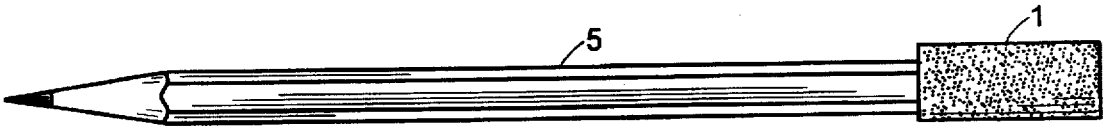
FIG. 2 is a side view of the pencil eraser cleaner 1 attached on pencil 5.
Figure 3:
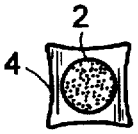
FIG. 3 is a end view of the pencil eraser cleaner 1 showing the four matted concave surfaces 4 of the invention and tapered hole 2 located on the center axis of said cleaner 1.

As shown in FIG. 1 the length of the pencil eraser cleaner is one and one eighth inches long by one half inches wide. A tapered hole 2 extends into the axis of the pencil eraser cleaner with a entrance diameter the same as a pencil.

Figure 4:
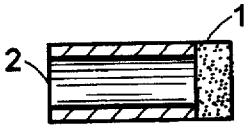
FIG. 4 is a side view of the pencil eraser cleaner showing the depth of the tapered hole into the said cleaner body 1.

FIG. 4 finish on the concave surfaces 4 may be one of three different types of abrasives.

Type 1 is a very fine dentifrice powder.

Type 2 is a plastic impregnated material with a matted surface.

Type 3 is a matted finish casted in the basic mold.

The matted finish on the pencil eraser cleaner provides a very smooth abravise surface. Rubbing a blackened pencil eraser over this type of abrasive quickly cleans the pencil eraser. Cleaning a pencil eraser on a matted surface retards eraser wear. It also extends the use of a pencil which in turn reduces consumption of wood. The provision of the concave surface(s) provides increased stability to the pencil when placed thereon. In other words, it helps prevent unwanted movement of the pencil when it is placed on a planar support surface such as a table top.

What is claimed is:

1. For use with a standard pencil having an eraser attached to an end thereof, an eraser cleaner comprising:

(a) an elongated body having opposite first and second ends, said body including at least one concave surface on an exterior of said body extending substantially the entire length of said body, said body having a hole for receiving the eraser end of the pencil, and said exterior of said body being abrasive; and (b) wherein the eraser of the pencil may be rubbed against the concave surface of the body to remove graphite from the pencil eraser, and wherein the erase cleaner, when placed on the pencil, provided increased stability thereto by virtue of the concave surface to limit movement thereof when the pencil is placed on a planar support surface.

* * * * *